United States Patent [19]

Kirtikar

[11] 4,124,854

[45] Nov. 7, 1978

[54] ELECTROSTATIC RECORDER WITH A RECORDING HEAD WHICH FLOATS ON A FLUID CUSHION

[75] Inventor: Suvrat Kirtikar, Pittsburgh, Pa.

[73] Assignee: Varian Associates, Inc., Palo Alto, Calif.

[21] Appl. No.: 553,849

[22] Filed: Feb. 27, 1975 (Under 37 CFR 1.47)

[51] Int. Cl.[2] ..... G03G 15/044

[52] U.S. Cl. ..... 346/155; 346/139 C

[58] Field of Search ..... 346/74 EH, 74 ES, 139 C, 346/74 S, 74 SB, 74 SC, 154, 153, 155; 360/103, 102

[56] References Cited

U.S. PATENT DOCUMENTS

| | | | |
|---|---|---|---|
| 2,919,171 | 12/1959 | Epstein | 346/74 S |
| 2,932,690 | 4/1960 | Adams | 346/74 ES |
| 2,959,636 | 11/1960 | Lemelson | 360/103 |
| 3,023,070 | 2/1962 | Benn | 346/74 ES |
| 3,076,968 | 2/1963 | Schwertz | 346/154 |
| 3,213,461 | 10/1965 | Goddard | 360/103 |
| 3,249,701 | 5/1960 | Silver | 360/103 |
| 3,631,509 | 12/1971 | Marshall | 346/74 ES |

*Primary Examiner*—Jay P. Lucas

*Attorney, Agent, or Firm*—Stanley Z. Cole; Robert K. Stoddard; Edward J. Radlo

[57] ABSTRACT

In a method and apparatus for electrostatically recording on a dielectric coated sheet, a recording head carrying a stylus array is spaced apart from the sheet to form an ionization gap. A charge image is transferred to the sheet by applying an activating voltage between selected styli and a back-up electrode. All styli receive a D.C. bias voltage and selected styli additionally receive "write" pulse voltage. The sum of the bias and write pulse voltages exceeds the threshold breakdown voltage of the gap to ionize the air in the gap under the selected styli. The charge image, created by the ionized air, is subsequently toned to form a visible image. The magnitude of the threshold breakdown voltage is dependent on the length of the gap and the required magnitude of the write pulses depends in part on how accurately the length of the gap is maintained constant. In order to accurately establish gap length and thereby minimize the required magnitude of the "write" pulses, an air cushion between the recording head and sheet is established by fluid jets of air emanating from apertures along the bottom of the recording head. The gap length is controlled by adjusting the air pressure forming the air jets. By adding moisture to the air, the humidity of the ionization gap is also controlled.

2 Claims, 6 Drawing Figures

FIG. 1
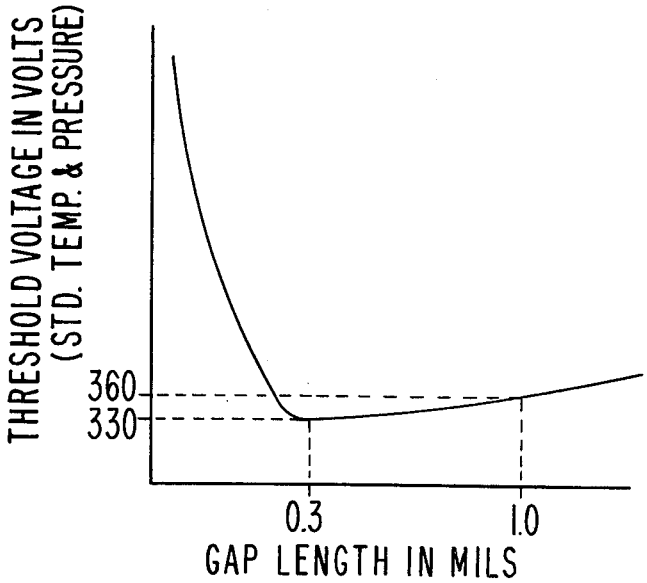
FIG. 2
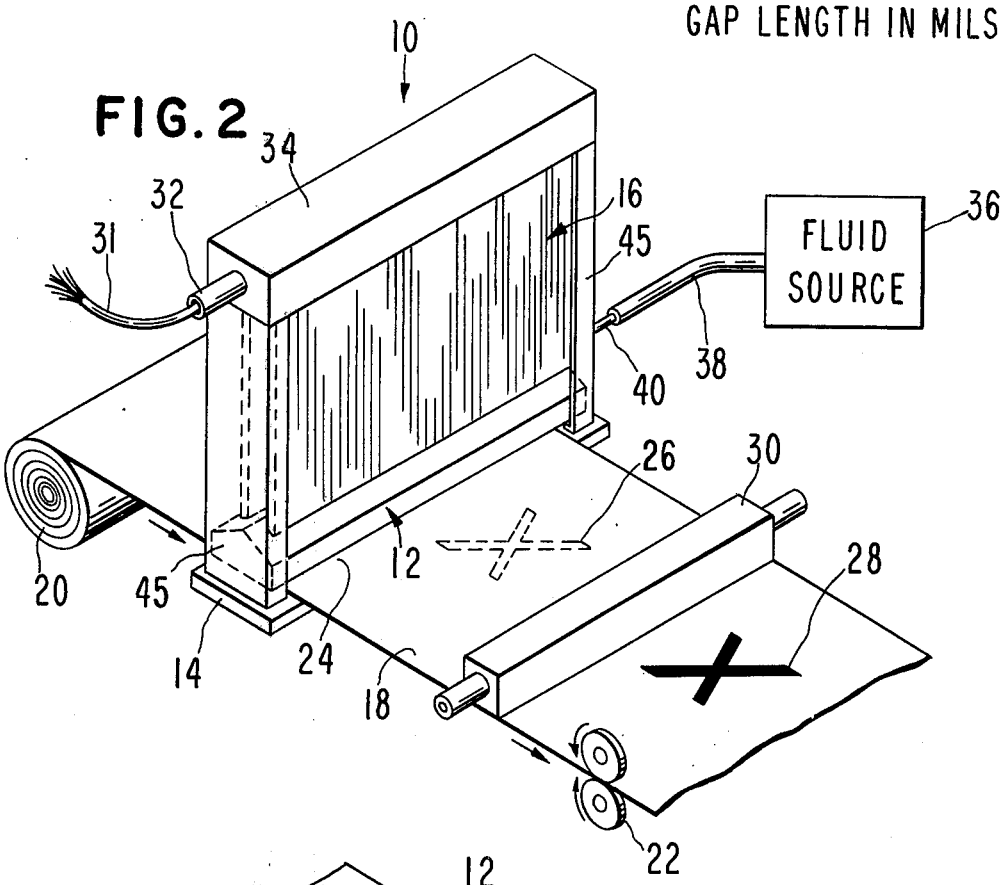
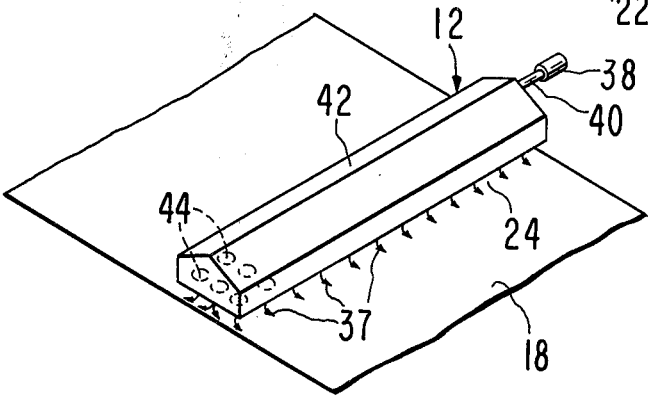
FIG. 3

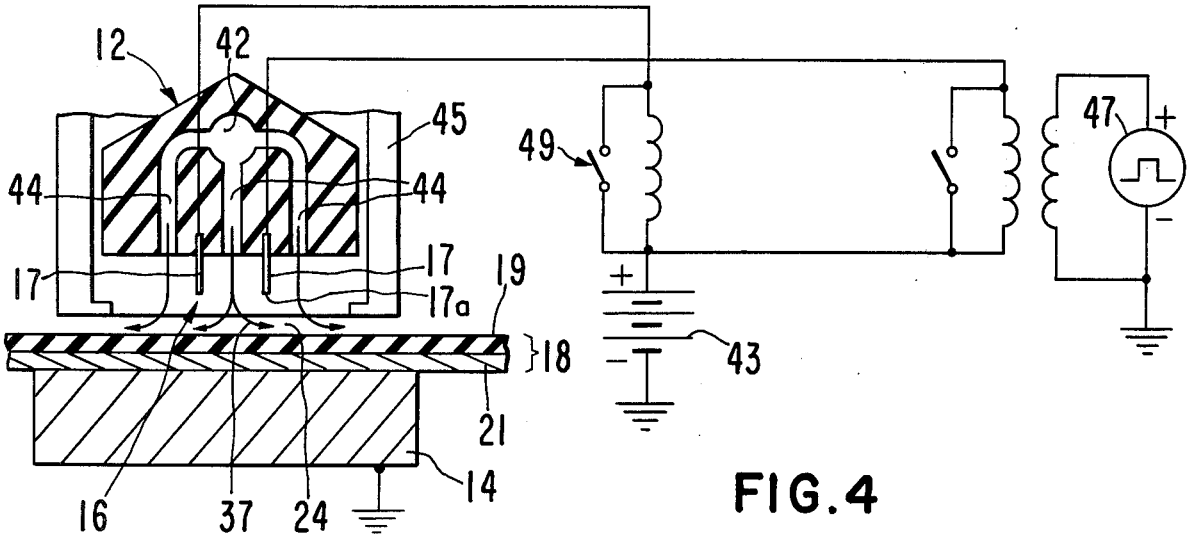
FIG.4
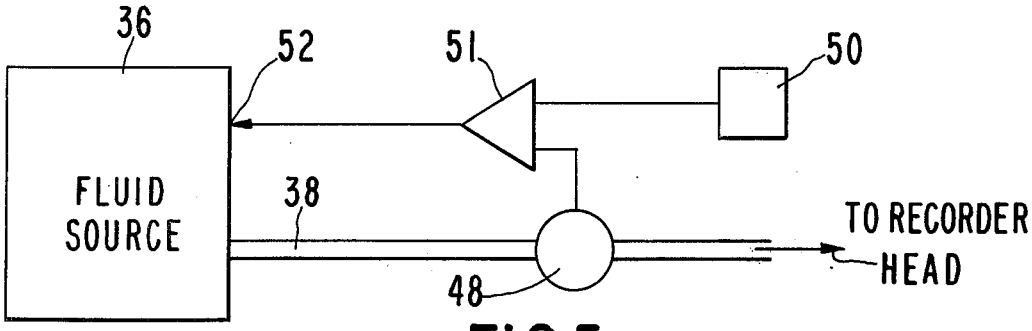
FIG.5
FIG.6
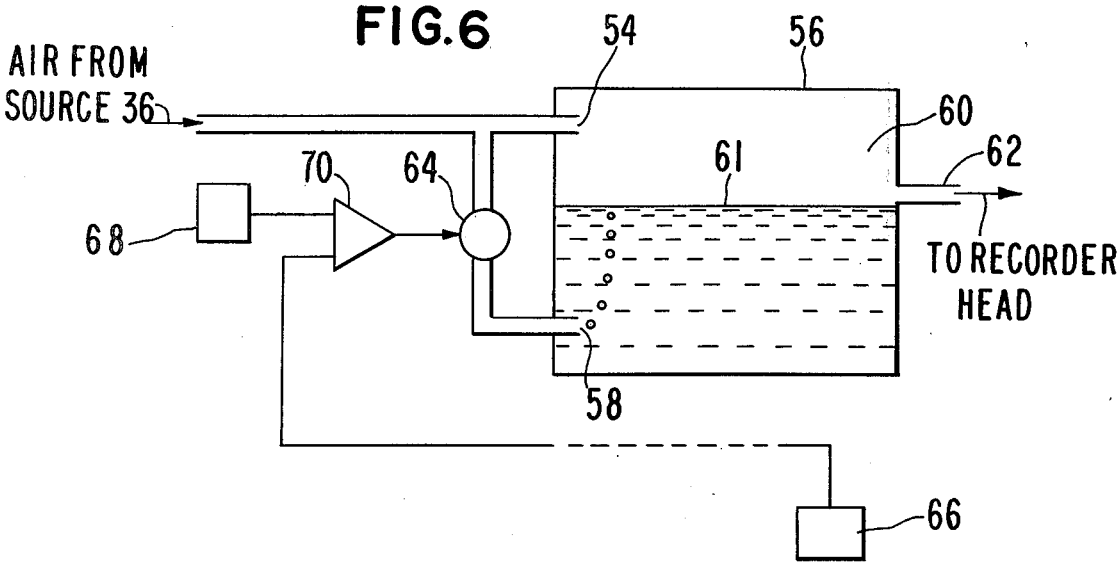

ELECTROSTATIC RECORDER WITH A RECORDING HEAD WHICH FLOATS ON A FLUID CUSHION

FIELD OF THE INVENTION

The present invention relates generally to electrostatic recording and more particularly to a method and apparatus wherein an air cushion controls an ionization gap between recording styli and a recording sheet.

DESCRIPTION OF THE PRIOR ART

In conventional electrostatic recorders, an image is recorded on a dielectric coated sheet or web by moving the sheet through an ionization gap between a recorder head and a back-up plate across which a voltage is applied. The recorder head contains a plurality of styli facing the sheet. The voltage includes a D.C. bias voltage applied between the styli and the back-up plate and write pulses individually applied to selected styli. The pulses, superimposed on the bias voltage, are of sufficient magnitude to cause the air between the selected styli and sheet to become ionized whereby a charge image is transferred to the surface of the sheet. In high speed computer printing, at least 4,000 styli may be mounted on the recording head and the "write" pulse applied to each must be individually controlled, requiring 4,000 separate switching devices.

Conventionally in an electrostatic recorder, the ionized air formed in the gap under each pulsed stylus is transferred to the sheet as a charge image. Subsequently, a toner fluid is deposited on the sheet to convert the charge image to a visible image that is fixed at a heating station.

The air gap length between the tips of the styli and the sheet is critical to the process of ionizing the air and transferring a charge image to the dielectric coated sheet. Other parameters which affect the ionization of air in the gap are temperature, pressure and humidity.

It is well known that when ionizing a fluid between a pair of electrodes, two competing phenomena occur. When the gap between the electrodes is very small, an applied voltage produces a high density electrostatic field in the gap. However, since relatively few air molecules are available for ionization in the small gap between the electrodes, a high applied voltage is required to produce an avalanche effect, which is necessary for creating adequate ionization in the gap to produce writing in an electrostatic printer. As the gap length between the electrodes is increased, more air molecules are available for ionization so that avalanche takes place with a lower electric field density in the gap. However, as the gap length between the electrodes is increased, the density of the electric field between the electrodes is decreased linearly and a higher applied voltage to sustain avalanching is required. These two conditions exist simultaneously and the threshold breakdown voltage for writing versus the length of the gap between the electrodes is non-linear as shown in the curve of FIG. 1. The curve shown in FIG. 1 is well known and called the Paschen curve, and has a relatively steep negative slope portion to the left of a gap length of 0.3 mil and a relatively small positive slope portion to the right thereof. The voltage minimum of the curve at the gap length of 0.3 mil, called the critical gap length, corresponds to a threshold breakdown voltage of 330 volts at standard temperature and pressure.

In the portion of the curve to the left of the critical gap length, the threshold breakdown voltage is highly sensitive to changes in length, while for gap lengths above the critical length, the magnitude of the threshold breakdown voltage is less sensitive to gap length in that region than in the region approximately the same as and less than the critical length.

Heretofore, the length of the gap between the recorder head and dielectric coated sheet positioned on a back-up electrode in an electrostatic recorder has been generally established by urging the sheet into direct contact with the recording head and relying on the surface roughness of the dielectric coating to provide the length of the ionization gap. Thus, a sheet of a single roughness has been consistently used in the recorder and the pressure between the back-up plate and stylus has been accurately maintained to provide uniform writing.

Several drawbacks are evident from the prior art construction. First, since the recorder head directly contacts the moving recording sheet, the head is subject to frictional wear. Also, a phenomenon known as "frictional writing" often occurs due to the electrostatic charge created by the action of the moving web against the stationary head and the moving web is occasionally erroneously marked by the inadvertently created electrostatic charge.

An even more serious drawback is created by the variation in web thickness and roughness between rolls, and even within a single roll, of the sheet. The required magnitude of the "write" pulses applied to the selected styli is directly related to the variation in roughness of the web because write pulses must be provided of sufficient magnitude to insure that the air in the gap between styli and coated sheet always ionizes when each pulse is applied. It is recalled that the styli all receive a D.C. bias voltage of an amplitude which is insufficient to cause ionization in the gap and additional "write" pulses are applied to selected styli. The "write" pulses must be of sufficient magnitude whereby each pulse, when added to the bias voltage, cause a localized ionization in the gap. If the gap length is accurately maintained at a fixed amount, a bias voltage can be applied to the stylus array which is just under the threshold breakdown voltage. Under that condition, relatively small "write" pulses can be applied to selected styli of the array to create ionization in the gap between those styli and the sheet or web. However, if the gap length is not accurately maintained, the bias voltage applied must be relatively low to avoid causing writing by the styli when the gap length becomes smaller when, for example, a thicker portion of sheet enters the area between styli and back-up plate.

In addition to maintaining the gap length constant, it is also desirable for the length to be relatively large, e.g., 1 mil. First, of a length at 1 mil, the sensitivity of threshold breakdown voltage with gap length is relatively small as seen in the positive slope area of the Paschen curve of FIG. 1. Secondly, at 1 mil, the size of the peaks and valleys in the sheet surface, compared with gap length, is small, and background noise, created by random writing as the peaks of the sheet pass through the gap, is eliminated.

Considering that up to 4,000 switches are required in an electrostatic recorder used as a computer output device, a large percentage of the total cost of the recorder unit is devoted to solid state switches. Since a large write pulse must be generated in a very short time in a conventional electrostatic recorder, a high slew rate is required of the switches. Because the slew rate of integrated circuit switches is limited, they cannot be used unless the write pulse magnitude be greatly reduced from that of conventional electrostatic recorders. Accordingly, relatively bulky and expensive discrete solid state switches have been used heretofore and the high voltage write pulses undesirably increase the response time of the recorder.

As still another drawback of the prior art construction, dust and lint have a tendency to migrate into the gap and interfere with charge transfer to the recording sheet. Also, changes in ambient humidity, pressure and temperature affect the threshold breakdown voltage.

OBJECTS OF THE INVENTION

Accordingly, it is one object of the present invention to provide a new and improved electrostatic recorder.

It is another object of the present invention to provide a new and improved electrostatic recorder which exhibits no wear of the recording head or frictional writing.

It is an additional object of the present invention to provide a new and improved electrostatic recorder which is free from dust and lint interference, and is relatively insensitive to changes in the recording sheet thickness or surface roughness.

It is a further object of the present invention to provide a new and improved electrostatic recorder requiring low magnitude writing pulses and having a short response time.

It is still another object of the present invention to provide a new and improved electrostatic recorder with a self-adjusting uniform ionization gap.

It is yet another object of the present invention to provide a new and improved electrostatic recorder with an ionization gap having a controlled humidity.

It is a further object of the present invention to provide a new and improved electrostatic recorder capable of using an integrated circuit switching array for controlling the application of "write" pulses to selected styli.

BRIEF DESCRIPTION OF THE INVENTION

In an electrostatic recorder, a controlled air gap between a styli-carrying electrostatic writing head and the dielectric coated sheet is maintained by forcing a thin film of fluid between the head and sheet. The fluid forms a cushion on which the head floats and the spacing between the head and the sheet is accurately controlled by controlling the pressure or the flow of the fluid. The interior of the recording head is channeled and a plurality of apertures is provided along the bottom surface of the recording head facing the sheet. A fluid source is applied to an intake port of the recording head and the applied fluid jets outwardly from the apertures to impinge on the sheet with sufficient force to cause the recording head to float on a fluid cushion thus formed. In order to control the humidity of the air in the writing gap, moisture may be added to the fluid by bubbling the fluid through a water reservoir and then passing the fluid to the channel in the recording head. The humidity of the fluid cushion is controlled by adjusting a bubbler valve in the reservoir.

While air bearings have previously been used as standoffs for magnetic recording heads and other devices, insofar as known, they have not previously been used for controlling the ionization gap of electrostatic recorders. In magnetic recording, the air bearing is usually arranged so that the head is as close as possible to the recording tape. Obviously, such a bearing cannot be utilized in electrostatic recording, where it is desirable to accurately maintain a separation greater than a predetermined distance between recording styli and the dielectric sheet.

The above and still further objects, features and advantages of the present invention will become apparent upon consideration of the following detailed description of several specific embodiments thereof, especially when taken in conjunction with the accompanying drawing.

BRIEF DESCRIPTION OF THE DRAWING

FIG. 1 is a graph of threshold breakdown voltage versus size of writing gap with a critical threshold voltage corresponding to a gap of approximately 0.3 mil;

FIG. 2 is a perspective view of an electrostatic recorder with the recording head thereof supported by a fluid cushion according to the present invention;

FIG. 3 is a detailed view of the recording head of the apparatus of FIG. 2;

FIG. 4 is a cross-sectional side view of the recording head, back-up plate and dielectric coated sheet;

FIG. 5 is a diagram of the self-adjusting control for the air gap; and

FIG. 6 is a schematic illustration of an embodiment of the invention in which the gap fluid passes through a water reservoir before being applied to the gap through the recording head to control humidity in an ionization gap.

DETAILED DESCRIPTION OF THE DRAWING

In FIG. 2, there is illustrated an electrostatic recorder 10 having a recording head 12 containing a stylus array 16 spaced apart from metal back-up plate or electrode 14. Sheet 18, comprising a base layer 21 on which is coated a charge retentive dielectric layer 19 (FIG. 4), is payed out from supply reel 20 and driven by opposed drive rollers 22 beneath recording head 12 to form ionization gap 24. When activated by a D.C. bias voltge and D.C. writing pulses, the styli in array 16 form a charge image 26 on the charge retentive dielectric layer 19 of recording sheet or web 18 and the charge image is converted into a visible image 28 by toning station 30. Recorder 10 receives electrical signals contained in wires of harness 31 routed into stylus addresser 34 at addresser input 32. The signals may be generated by a computer programmed to be outputted in graphical format. The harness wires are individually connected to the styli of array 16 through a separate switch for each stylus as discussed in more detail infra. The switches are preferably contained within the recorder 10, or alternatively may be provided as an interface at the output of the computer. Alternatively a segmented back-up plate (not shown) may be employed and may be driven by multiplexed enabling signals to reduce stylus switching requirements.

According to the present invention, the desired length of gap 24 is accurately maintained between stylus array 16 and dielectric coated sheet 18 by a fluid cushion or fluid bearing 37 between the lower face of head 12 and the upper surface of sheet 18 shown in FIG. 3.

Fluid cushion 37 is provided in gap 24 by a fluid source 36. The fluid may be easily ionizable gas such as hydrogen or oxygen or an easily ionizable liquid such as toning fluid or Freon. In consideration of the ease of handling and economy of ordinary air, air is a preferred fluid for this application notwithstanding the relatively high ionization voltage thereof. A hose 38 connects fluid source 36 to intake port 40 in recording head 12. A shown in FIG. 4, the interior of recording head 12 is channeled forming chamber 42 and a plurality of apertures 44 is formed along the bottom surface of the recording head extending through to the channel. Styli 17 having tips 17*a* extend outwardly from the bottom surface of head 12. When the fluid is applied under pressure to head 12, fluid jets are directed downwardly against recording sheet 18 through apertures 44 with sufficient force to cause recording head 12 to float on fluid cushion 37. Stop 45 prevents head 12 from striking sheet 18 when fluid cushion 37 is not applied. A bias voltage is applied to each stylus 17 from D.C. voltage source 43 and writing pulses from pulse source 47 are selectively coupled to the styli by means of switches 49 which are preferably integrated circuit elements, although they are illustrated as being of the electromechanical type.

The length of gap 24 maintained by fluid cushion 37 is determined by the fluid pressure of fluid source 36 or the flow rate of the fluid and those parameters are controlled whereby gap 24 is preferably maintained on a relatively constant positive slope portion of the Paschen curve of FIG. 1, at approximately one mil.

Although a gap larger than a critical length (0.3 mil for a voltage of 330 volts) requires a higher D.C. bias voltage to approach the threshold breakdown voltage of the gap than a gap of critical length, in practice a lower magnitude writing pulse for a desirable dark visible image 28 may be provided to the larger gap. At 1 mil gap length, I have found that a bias voltage just under the threshold breakdown voltage can be applied to the array without causing accidental writing. Only relatively small writing pulses are required for writing because the peaks and valleys of sheet 18 corresponding to the surface roughness thereof are small compared to the length of the gap an the threshold breakdown voltage is not significantly affected thereby.

With an accurately maintained gap of one mil (approximately 25 microns) and a typical web surface having 5 micron peaks and valleys, gap length variation due to surface roughness of the sheet is a much smaller percentage (±20%) of the total gap size than that which was possible (±50%) in the prior art structure of direct contact between a head and sheet where the average gap is approximately 10 microns. Therefore, a D.C. bias voltage just under the threshold breakdown voltage can be applied to the stylus array with relatively low writing pulses being applied to selected styli for writing. Since the size of the peaks of the sheet is small compared to gap length and threshold breakdown voltage is relatively insensitive to gap length at 1 mil (see FIG. 1), erroneous random writing caused as sheet surface peaks enter the gap does not occur.

The size of the gap can be accurately controlled either by adjusting the pressure of fluid supplied to recording head 12 to create an amount of flow known to correspond to desired gap length or adjusting the flow rate of the fluid to create a known desired back pressure. For example, in the preferred embodiment, fluid is applied to head 12 under pressure and fluid flow rate to the head is monitored. When the flow rate exceeds the value corresponding to a writing gap of 1 mil, the length of the writing gap is known to be too large, and in response thereto, the pressure of fluid source 36 is automatically decreased until the flow of fluid properly corresponds to the desired writing gap length.

FIG. 5 is a schematic illustration of apparatus for automatically maintaining the length of gap 24 constant and includes fluid source 36, flow meter 48, reference flow signal generator 50 and difference amplifier 51. The fluid source 36 supplies a fluid, preferably air, under pressure to floating head 12 through hose 38. The amount of air reaching the recording head is monitored by flow meter 48 that is in line 38. Reference source 50 applies a signal to one input of difference amplifier 51. Although reference source 50 can correspond to any desired gap length, the output thereof preferably is related to the flow of air corresponding to a one mil length of the writing gap 24. To the other input of difference amplifier 51 is applied a signal generated by flow meter 48. An error signal representing the difference between the actual flow in hose 38, as measured by flow meter 48, and the desired flow applied by source 50 is generated by amplifier 51 and fed back to a pressure control input 52 of fluid source 36.

In operation, while sheet 18 is being moved under recording head 12 within gap 24, the control arrangement of FIG. 5 maintains the recording head separated from the web to maintain the length of the writing gap between styli and back-up plate electrode 14 at the desired value, e.g., one mil. Should the thickness of sheet 18 increase, the gap length 24 becomes reduced and the amount of air flowing into the gap necessarily decreases. The decrease in fluid flow rate is detected by flow meter 48 and the difference between the actual flow rate and desired flow rate set by source 50 causes an error voltage to be derived from difference amplifier 51. The error voltage applied to control input 52 of fluid source 36 causes the pressure of source 36 to increase until the error voltage applied to control input 52 is again zero. Thus, the increased pressure applied to recorder head 12 re-establishes gap 24 to the desired one mil length. It is apparent that, in a similar manner, when sheet 18 becomes thinner, the control arrangement of FIG. 5 automatically decreases the pressure of source 36 to re-establish the length of the writing gap. Accordingly, the length of gap 24 is maintained at the predetermined value, e.g., one mil, notwithstanding changes in thickness of the sheet.

Since recording head 12 is no longer in direct contact with sheet 18 passing thereunder, frictional wear of the head is completely eliminated. In addition, the fluid jet emerging from apertures 44 in recording head 12 blows off dust and lint entering writing gap 24, generally before they can interfere with the charge transfer process.

The ionization voltage of the writing gap is also a known function of humidity because water molecules more easily ionize under an electric field than do air molecules. Thus, when humidity is high, the air in writing gap 24 is more readily ionized requiring a lower threshold breakdown voltage. In order to maintain a constant threshold breakdown voltage, it is desirable to maintain the air in writing gap 24 at a constant humidity, as is accomplished with the constant humidity controller of FIG. 6. Air from dry air source 36 flows into an upper port 54 of water reservoir 56 and thence across the surface of a pond 61 in the reservoir so that the moisture content of the air is increased. Control for the moisture content is provided by bubbling gas from a submerged port 58 through the pond to the surface of the pond. The bubble flow rate, and therefore the humidity of the air leaving reservoir 56 through output port 62, is controlled by adjusting bubbler valve 64 to direct more or less air from source 36 through submerged port 58. The air leaving output port 62 is directed to input port 40 of recorder head 12 (in FIGS. 2 and 3) to form air cushion 37 having a constant humidity. By maintaining a constant humidity, variations in threshold breakdown voltage of the writing gap 24 with changes in ambient room humidity are eliminated.

Generally, bubbler valve 64 is set to a predetermined position corresponding to a desired average humidity in writing gap 24. The humidity may be set to a relatively high value so that small changes in ambient humidity do not significantly affect the humidity of the gap. However, if desired, an even more accurate constant humidity source can be provided by including humidity sensor 66 in proximity to writing gap 24. Sensor 66 generates a signal which, in difference amplifier 70, is compared to a humidity set point signal representing a desired humidity. The difference can be used to automatically adjust bubbler valve 64 to maintain a constant humidity in the gap.

In summary, an electrostatic recorder has been provided with a fluid cushion for accurately maintaining a constant desired gap length and constant humidity in the gap. Since the recording head is spaced away from the moving web, the head does not wear and frictional writing is eliminated. Of particular importance, the required magnitude of the writing pulses is greatly reduced when a self-adjusting gap length of 1 mil, for example, is provided. In practice, I have found that writing pulses of the order of 10 volts added to a D.C. bias of approximately 360 volts reliably produce ionization in the gap. Since only 10 volts is switched during writing of recorder 10, it is apparent that ionization response time is short and low slew rate integrated circuit switching arrays can be used to apply write pulses to the stylus array resulting in a more compact and economical system.

While there have been described and illustrated several specific embodiments of the invention, it will be clear that variations in the details of the embodiments specifically illustrated and described may be made without departing from the true spirit and scope of the invention as defined in the appended claims.

What is claimed is:

1. Electrostatic recording apparatus for recording information on a dielectric sheet comprising:

an electrostatic recorder head including a stylus having a tip;

a back-up electrode positioned in proximity to said tip;

an ionization gap adapted to receive the sheet being formed between said stylus tip and electrode;

means for selectively applying a voltage between said stylus and electrode, said voltage being of sufficient magnitude to create ionization in said gap;

means for maintaining at least a minimum predetermined gap length of 0.3 mil between said stylus and said sheet;

said maintaining means including means for producing a fluid flow between said head and said electrode to create a fluid cushion for supporting said head; and means for controlling the humidity in said ionization gap; wherein said humidity controlling means includes a source of liquid and means for applying said fluid to said source of liquid before application of said fluid between said stylus and said electrode;

said humidity controlling means further including means for measuring the humidity of the air in said gap to derive a humidity control signal; and means responsive to the humidity control signal for mixing liquid from said source with said fluid.

2. A method of selectively applying electric charge to a dielectric sheet located in a gap between a stylus tip and a back-up electrode comprising the steps of:

supplying ionizable fluid to the gap to establish a fluid bearing causing the tip to float at a predetermined distance greater than 0.3 mil away from the electrode, said distance being such that the gap has a threshold voltage on a relatively constant positive slope portion of a Paschen curve; and ionizing the fluid supplied to the gap by supplying sufficient voltage between the tip and electrode to exceed the threshold voltage;

said method further including the steps of:

measuring the humidity of the fluid in said gap;

comparing said measured humidity to a desired humidity; and adding a quantity of a liquid to said fluid in accordance with said comparison to maintain the humidity of said fluid substantially constant.

* * * * *